US010434348B2

(12) United States Patent
Zhao et al.

(10) Patent No.: US 10,434,348 B2
(45) Date of Patent: Oct. 8, 2019

(54) PLANT TYPE ACTIVE ANTIFLAMING EXTINGUISHANT AND PREPARATION METHOD AND APPLICATION THEREOF

(71) Applicant: Ningbo Mercury Environmental Technology Co., Ltd., Zhejiang (CN)

(72) Inventors: Zhongwei Zhao, Zhejiang (CN); Fangyi Zhao, Zhejiang (CN); He Zhuo, Zhejiang (CN); Chenguang Zhuo, Zhejiang (CN)

(73) Assignee: NINGBO MERCURY ENVIRONMENTAL TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 15/794,787

(22) Filed: Oct. 26, 2017

(65) Prior Publication Data

US 2019/0105522 A1 Apr. 11, 2019

(30) Foreign Application Priority Data

Oct. 10, 2017 (CN) ..... 2017 1 0937071

(51) Int. Cl.
*A62D 1/00* (2006.01)
*A62D 1/02* (2006.01)

(52) U.S. Cl.
CPC ..... *A62D 1/0035* (2013.01); *A62D 1/00* (2013.01); *A62D 1/0028* (2013.01); *A62D 1/0071* (2013.01)

(58) Field of Classification Search
None
See application file for complete search history.

(56) References Cited

FOREIGN PATENT DOCUMENTS

| | | | |
|---|---|---|---|
| CN | 85107439 | | 4/1987 |
| CN | 1341469 | | 3/2002 |
| CN | 105582636 A | * | 5/2016 |

OTHER PUBLICATIONS

English Translation of CN 1341469 dated Mar. 2002.*

* cited by examiner

*Primary Examiner* — Tanisha Diggs
(74) *Attorney, Agent, or Firm* — Andrew F. Young, Esq.; Lackenbach Siegel, LLP

(57) ABSTRACT

The invention discloses a plant type active antiflaming extinguishant and preparation method and application thereof, wherein the plant type active antiflaming extinguishant is mainly prepared by compounding 15-20% of plant anti-burning agent, 8-17% of plant composite flame retardant active agent and 63-82% of plant slag water, etc.; and mixed with water at a concentration of 1-5%, and the mixed liquid is filled into fire extinguishing equipments for supporting use. The plant type active flame retardant extinguishing agent provided by the present invention increases a variety of plant fruits, increases the different sources of plant protein, pectin, polyhydroxy compounds rich in tannin, lignin and anti-burning material, and obtains a stronger extinguishing function and an ideal extinguishing effect, which is beyond the reach of the existing fire extinguishing agent; raw material is easy to get and its price is low, and manufacturing process and required equipment are easy to access.

6 Claims, 5 Drawing Sheets

PLANT TYPE ACTIVE ANTIFLAMING EXTINGUISHANT AND PREPARATION METHOD AND APPLICATION THEREOF

CROSS-REFERENCE TO RELATED APPLICATIONS

The present application claims priority to and the benefit of Chinese Patent Application No. CN 201710937071.8, filed on Oct. 10, 2017, the entire content of which is incorporated herein by reference.

BACKGROUND OF THE INVENTION

1. Field of the Invention

The present invention belongs to the field of fire extinguishing technique, and relates to an extinguishing agent, and more particularly, to a plant type active antiflaming extinguishant comprising a plurality of plants, fruit extracts and plant slag water as main components, and a process and application thereof.

2. Description of the Related Art

Shocking fire poses a serious threat to the people's life and property safety. And fire extinguishing agent plays a key role in controlling the fire loss. Four drawbacks of the existing extinguishing agent are as follows: firstly, the extinguishing agent (e.g. halon extinguishing agent) is prohibited due to its impact on the human environment, causing environmental pollution; secondly, extinguishing efficiency is less satisfactory than the actual effect; thirdly, extinguishing range is limited, wherein it has a poor effect on extinguishing fire arising from polar solvent, liquefied petroleum gas and natural gas; last but not least, the treatment of post extinguishment and expired product will bring great harm to land and water sources.

Patent No. CN1341469A discloses a plant type composite flame retardant active agent, which is diluted with water and made into an extinguishing agent, and then filled into portable fire extinguisher for extinguishing fire of Class A, Class B, Class C, however, it has been found in later practice that the extinguishing agent has good effect in extinguishing a small range of fire with its area less than 2A or 10B, while in larger area of fire, it is difficult to achieve satisfactory results.

In addition, Patent No. CN1005719C discloses a plant active flame retardant extinguishing agent, which comprises plant composite flame retardant active agent and active water made from grain stillage and plant ash through water leaching, wherein the grain stillage having dry basis of 12-20 parts, plant ash has 3-5 parts, and water is added to the total weight, amounting to 100 parts; the weight ratio of the plant composite flame retardant active agent and the active water is 10-25; 75-90 respectively; its main technical scheme is to perform compounding processing on the active water made through the leaching processing of grain stillage and plant ash and plant composite flame retardant active agent, to produce a plant active flame retardant extinguishing agent. However, with the continuous improvement of fire protection technology, the requirement of performance on the large-scale fire extinguishing agent has become increasingly higher, and in practical applications, it has been found that the durability of this plant active flame fire retardant extinguishing agent cannot meet the requirements of achieving fire extinguishment in a fast, high-speed and environment-friendly way, therefore, the property of fire suppression needs to be improved further.

SUMMARY OF THE INVENTION

In order to develop a more effective fire extinguishing agent for fire suppression with fire extinguisher, fire engine and fixed fire extinguishing system, the present invention provides a plant active antiflaming extinguishant and preparation and application thereof.

In order to achieve the above-mentioned objectives, the present invention adopts the following technical scheme:

According to a first aspect of the present invention, there is provided a plant type active antiflaming extinguishant comprising a plant anti-burning agent, a plant composite flame retardant active agent, and plant slag water.

Further, in the plant type active antiflaming extinguishant, the plant anti-burning agent comprises the following components by weight percentage:

| | |
|---|---|
| Clove | 0.05-0.18% |
| Corncob | 2.6-10% |
| Lemon peel | 0.4-1.5% |
| Eggplant | 2.4-3.6% |
| Sugar beet pulp | 2.2-3.8% |
| Active water | 82-92% |

More preferably, in the plant type active flame retardant extinguishing agent, the plant anti-burning agent comprises the following components by weight percentage:

| | |
|---|---|
| Clove | 0.08-0.14% |
| Corncob | 4-8% |
| Lemon peel | 0.7-1.2% |
| Eggplant | 2.7-3.2% |
| Sugar beet pulp | 2.8-3.5% |
| Active water | 84-89% |

More preferably, in the plant type active antiflaming extinguishant, the plant anti-burning agent comprises the following components by weight percentage:

| | |
|---|---|
| Clove | 0.1-0.12% |
| Corncob | 5.3-6.2% |
| Lemon peel | 0.8-1.0% |
| Eggplant | 2.9-3.0% |
| Sugar beet pulp | 3.0-3.2% |
| Active water | 85-87% |

Further, in the plant type active antiflaming extinguishant, the plant composite flame retardant active agent uses the plant active antiflaming extinguishant described in Patent No. CN1341469A.

Furthermore, in the plant type active antiflaming extinguishant, the plant slag water is composed of plant slag ash and water, and slag of plant material extracted with the plant anti-burning agent is dried in the sun and incinerated to produce the plant slag ash.

Further still, in the plant type active antiflaming extinguishant, the plant active antiflaming extinguishant comprises the following components by weight percentage:

| | |
|---|---|
| Plant anti-burning agent | 10-20% |
| Plant composite flame retardant active agent | 8-17% |
| Plant slag water | 63-82% |

More preferably, in the plant type active antiflaming extinguishant, the plant type active antiflaming extinguishant comprises the following components by weight percentage:

| | |
|---|---|
| Plant anti-burning agent | 12-17% |
| Plant composite flame retardant active agent | 10-15% |
| Plant slag water | 68-78% |

More preferably, in the plant type active antiflaming extinguishant, the plant type active antiflaming extinguishant comprises the following components by weight percentage:

| | |
|---|---|
| Plant anti-burning agent | 15-17% |
| Plant composite flame retardant active agent | 12-13% |
| Plant slag water | 70-73% |

According to a second aspect of the present invention, there is provided a preparation method of the plant type active antiflaming extinguishant, comprising the steps of:

step 1, preparation of plant anti-burning agent:

The dry clove, lemon peel, corncob, eggplant, sugar beet pulp (dry basis) are cut into 5~15 mm blocks, and the blocks are added to the active water according to the proportion of weight, soaking at room temperature for 10-12 hours, and then preserving at 80-85 centigrade degree for 6 hours, and discharging and filtering the material when the temperature falls below 35 centigrade degree, wherein the liquid supernatant is the plant anti-burning agent;

step 2, preparation of plant slag water:

The slag of plant material extracted with the plant anti-burning agent is dried in the sun and incinerated in the incinerator to produce the plant slag ash. Adding the plant slag ash to the tap water for soaking wet, then stirring for 30 minutes, standing still for 24 hours, and keeping on stirring for 30 minutes, after another 24 hours, the material is discharged and filtered, wherein the liquid supernatant is the plant slag ash agent;

step 3, preparation of plant antiflaming extinguishant:

The quantitative plant slag ash water is added to a agitation reactor, and the quantitative plant anti-burning agent is then added while stirring. Raising the temperature to 50-55 centigrade degree and stirring for 2 hours at 50-55 centigrade degree. Discharging and filtering the material when the temperature falls below 38 centigrade degree, and the plant active antiflaming extinguishant is produced in the end.

Further, in the preparation method of the plant type active antiflaming extinguishant, the total amount of pectin, dissolved oil, limonene, cresol lactone, unsaturated organic acid, polyhydroxy compounds rich in tannin and plant protein contained in the plant anti-burning agent prepared in the step 1 is not less than 17%.

Further, in the preparation method of the plant type active antiflaming extinguishant, the amount of plant slag ash and water in step 2 is 2-8:92-98.

More preferably, in the preparation method of the plant type active antiflaming extinguishant, the amount of plant slag ash and water in step 2 is 3-6:94-97.

According to a third aspect of the present invention, there is provided an application of the plant type active antiflaming extinguishant in extinguishing fires.

Further, in the application of the plant type active antiflaming extinguishant in extinguishing fires, specifically, the plant type active antiflaming extinguishant is mixed with water at a concentration of 1 to 5%, and is filled into a portable fire extinguisher, a foam nozzle, a fire engine, or is used with a large scale fire-fighting equipment.

A new type of plant active antiflaming extinguishant provided by the present invention can fully implement the rescue for fire Class of A, B and C to achieve a rapid, high-efficient and environment-friendly fire fighting. The mechanism of the modified fire extinguishment is as follows:

1. Changing the Physical Nature of the Combustion Material

When the plant type antiflaming extinguishant is mixed with a combustion material, its own fire fighting energy can quickly modify the combustion material, while modifying the combustion material, plant type flame retardant extinguishing substances (e.g. alkaloids, phosphate, potassium), surface active substances (e.g. vegetable protein, fatty acid, polysaccharide, saponin, dissolved oil), film active substances (e.g. pectin, gum, phosphate, cellulose), modified reduction substances (compounds rich in tannin polyphenols, lignin, cellulose) and other substances are dissolved in the combustion material, such that it changes its flammability and becomes a flame retardant, non-combustible substance, playing a role in changing the property of a combustion material, forcing the combustion material to stop burning.

2. Rapid Cooling

Plant type antiflaming extinguishant comprises a plurality of components containing fast heat absorbing and anti-burning substances. The specific heat of water is 1 cal/g, when IL of water is gasified through evaporation, the substance needs to absorb 539 Kcal of heat, the volume is expanded by 1720 times, while fast heat-absorbing substance of the plant type antiflaming extinguishant, when IL liquid containing 10% of the heat-absorbing substance is gasified through evaporation, it needs to absorb 3290 Kcal of heat, the volume is 6 times bigger than water, then the mixed vapor of the fire extinguishing agent accounts for 50-70-90% of the combustion space, forcing the combustion to stop burning.

3. Achieving Flame Retardancy Through Dilution

Modified flame retardant substance of the plant type antiflaming extinguishant is easily soluble in water, so as for water-soluble flammable substance, it has three effects on diluting, modifying the substance, and making it flame retardant at a time. The flame can be extinguished automatically when the supply intensity of the fire extinguishing agent satisfies the flammable concentration of the diluted, flame retardant, and modified combustion substance or when the combustion intensity of the fire extinguishing agent falls below the limit of maintaining combustion.

4. Film Sealing

Because in a plant type antiflaming extinguishant, all the modified substances and film substances are sensitive to the temperature, and easy to agglomerate into a film, and it can also form different films (net film, foam film, film, burnt film, aqueous film and composite film) and the different films covers the surface of the combustion substance, acts as a barrier to oxygen and heat, thereby enclosing the combustible gas, cutting off the heat transfer, and finally forcing the combustion material to stop burning.

5. Anti-Burning and Environmental Protection Property

Since the clove, the corn cob, the lemon peel, the eggplant and the sugar beet pulp used in the plant type active antiflaming extinguishant comprise adsorbents, such as polyhydric phenolic compounds such as tannin, pectin, limonene, unsaturated organic acid, lignin, cellulose, humic acid, which not only adsorb heavy metal pollution, but also dissolve sewer and river bed oil pollution, and it can effectively ease the treatment of post extinguishment and treatment related to the expired product, thus providing effective help to the pollution control of the earth and river bed.

The plant type active antiflaming extinguishant provided by the present invention adopts the above 1-5 functions to coordinate and interact with one another, to obtain a stronger extinguishing function and an ideal extinguishing effect; in particular, the inventive plant type active antiflaming extinguishant uses plant anti-burning agent, plant slag ash agent and plant composite flame retardant active agent for compounding, adding plant protein of different sources, fire-fighting substances, anti-burning substances, colloidal substances, modified substances, corrosion-resistant substances, all of which play a great role in extinguishing fire and increasing anti-burning efficiency. In addition, when it comes to the sealing performance and the extremely strong fire extinguishing power produced by the fire extinguishing agent of the invention, the existing fire extinguishing agent is not as good as the fire extinguishing agent provided in the present invention, which has been confirmed from the experiment on $50^2$ m oil pool and $5000^3$ m oil tank.

Compared with the prior art, the foregoing technical scheme according to the present invention has the following effects:

The plant type active antiflaming extinguishant provided by the present invention has good performance in terms of fire extinguishment result and environmental protection effect, which are beyond the reach of the existing fire extinguishing agent. Further, raw material is easy to get and its price is low, and manufacturing process and required equipment are easy to access, and therefore, the cost is low, specifically, its cost is half the price of the AFFF fire extinguishing agent, but its modified fire-extinguishing effect is ⅓ higher than that of the AFFF extinguishing agent. Moreover, it is easy to use, applicable for a portable fire extinguisher, a foam gun, a fire engine, or is used with a large scale fire-fighting equipment, applicable for large area of fire extinguishment concerning Class A, B and C.

DETAILED DESCRIPTION

Figure 1:
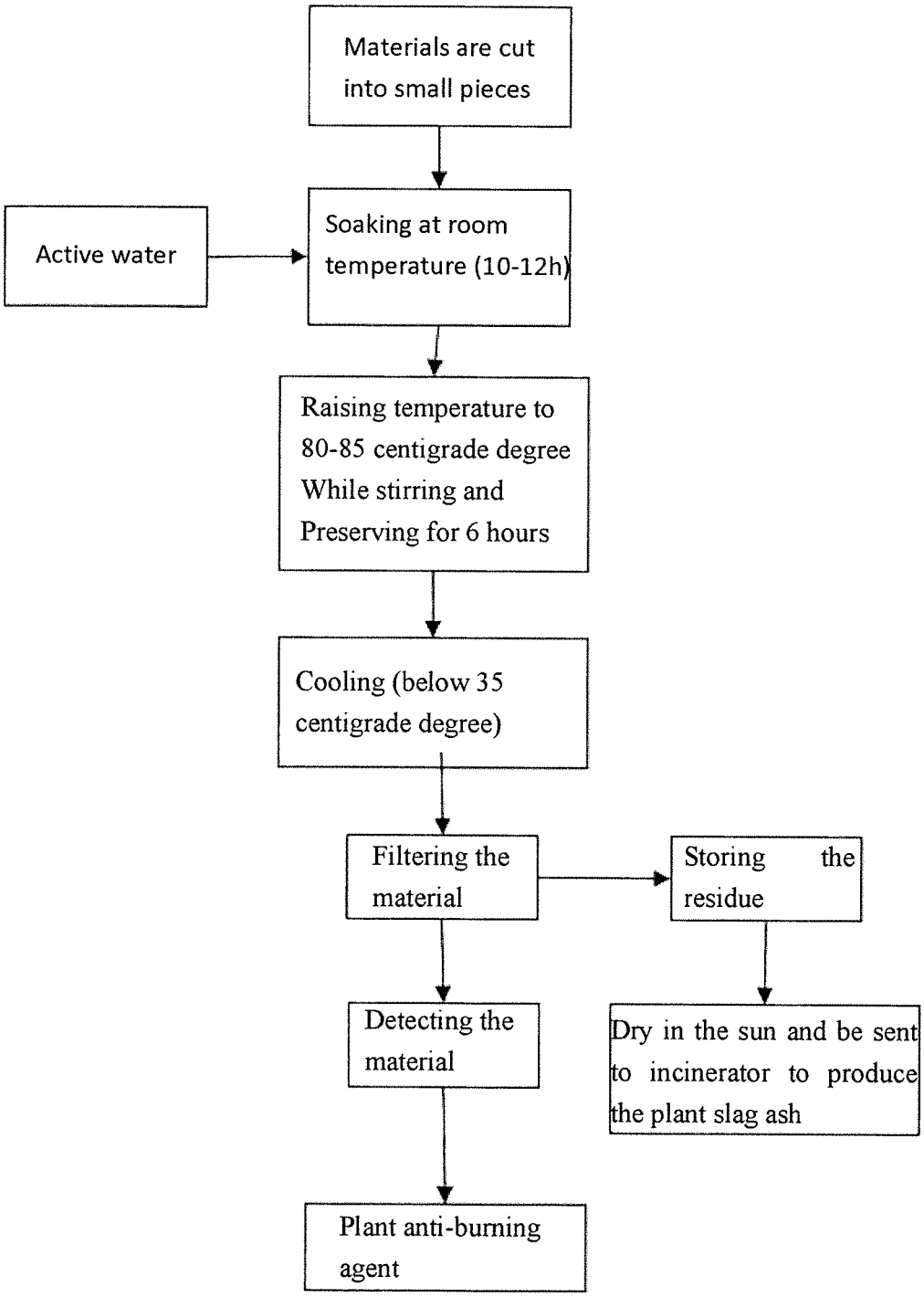
FIG. 1 is a flow chart of the preparation process of the plant anti-burning agent according to the present invention.

The invention firstly provides a plant type active antiflaming extinguishant, which comprises a plant anti-burning agent, a plant composite flame retardant active agent and plant slag water. The inventors of the present invention have confirmed via research that the plant anti-burning agent, which has been leached from clove, corn cob, lemon peel, eggplant, sugar beet pulp and plant slag ash, is compounded with the aforementioned plant composite flame retardant active agent to produce a new plant type antiflaming extinguishant, to meet the needs of large-scale fire fighting, such as extinguish large-scale oil storage tank, large-scale storage pool, polar solvent.

The plant anti-burning agent of the present invention consists of the following components: 0.05-0.18% of clove, 2.6-10% of corn cob, 0.4-1.5% of lemon peel, 2.4-3.6% of eggplant, 2.2-3.8% of sugar beet pulp, and 82-92% of active water; preferably, the plant anti-burning agent comprises the following components by weight percentage: 0.08-0.14% of clove, 4-8% of corn cob, 0.7-1.2% of lemon peel, 2.7-3.2% of eggplant, 2.8-3.5% of sugar beet pulp, and 84-89% of active water; more preferably, the plant anti-burning agent comprises the following components by weight percentage: 0.1-0.12% of clove, 5.3-6.2% of corn cob, 0.8-1.0% of lemon peel, 2.9-3.0% of eggplant, 3.0-3.2% of sugar beet pulp, and 85-87% of active water; much more preferably, the plant anti-burning agent comprises the following components by weight percentage: clove of 0.1%, 6% of corn cob, 1% of lemon peel, 2.9% of eggplant, 3% of sugar beet pulp, and 87% of active water.

In the plant type active antiflaming extinguishant according to the present invention, the plant composite flame retardant active agent uses the plant active antiflaming extinguishant described in Patent No. CN1341469A, and the performances and technical features are described in detail in the plant composite flame retardant active agent. The plant slag water used is composed of plant slag ash and water, wherein the slag of plant material extracted with the plant burning resisting agent is dried in the sun and incinerated ash to produce the plant slag ash.

Components ratio of the plant type active antiflaming extinguishant of the present invention is: by weight percentage, the plant type active antiflaming extinguishant comprises 10-20% of plant anti-burning agent, 8-17% of plant composite flame retardant active agent, and 63-82% of plant slag ash; preferably, 12-17% of plant anti-burning agent, 10-15% of plant composite flame retardant active agent, and 68-78% of plant slag ash; more preferably, 15-17% of plant anti-burning agent, 12-13% of plant composite flame retardant active agent, and 70-73% of plant slag ash; more preferably, 17% of plant anti-burning agent, 15% of plant composite flame retardant active agent, and 68% of plant slag ash.

Figure 2:
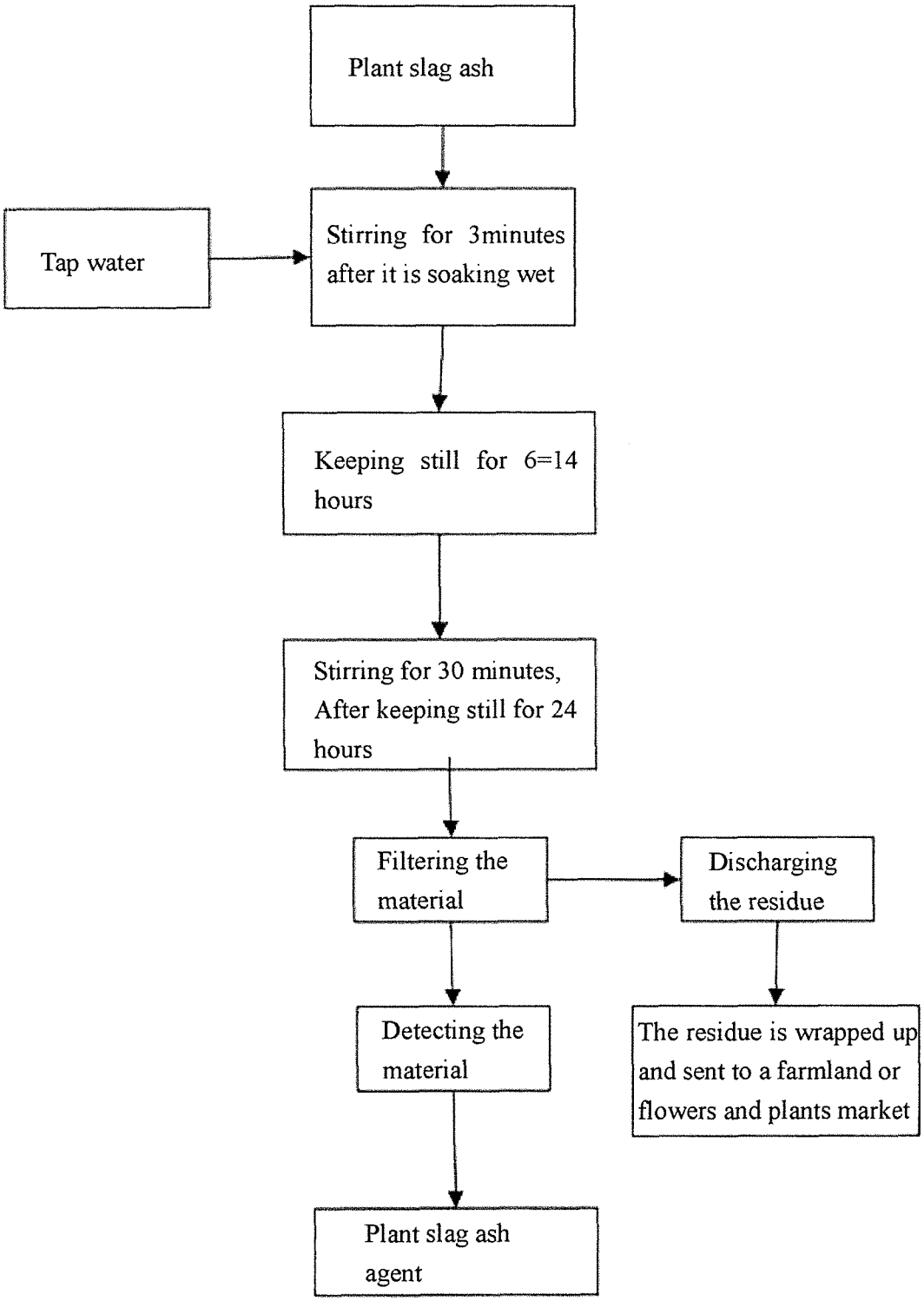
FIG. 2 is a flow chart of the preparation process of the plant slag ash agent according to the present invention.
Figure 3:
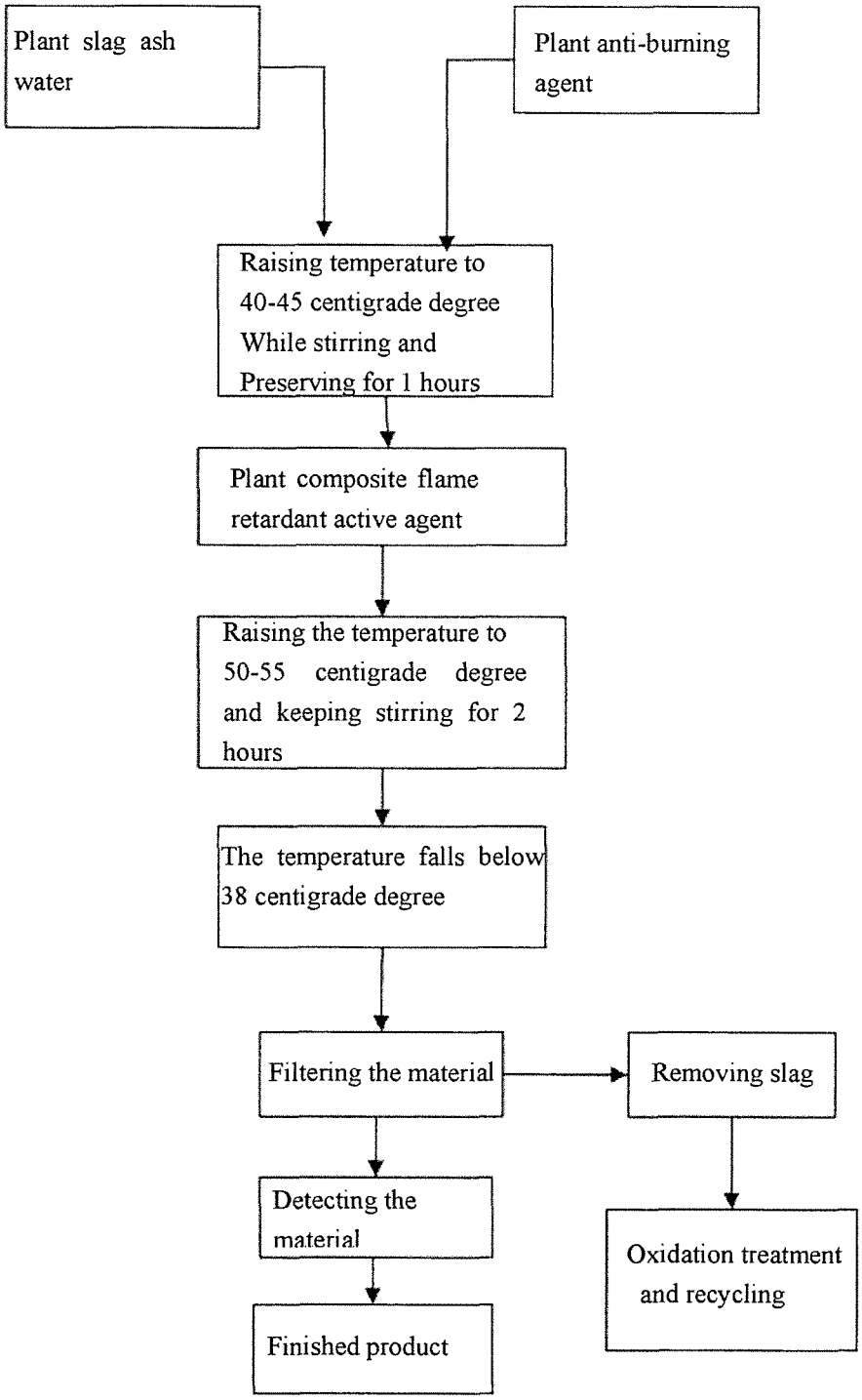
FIG. 3 is a flow chart of the production process of the plant type antiflaming extinguishant according to the present invention.

Based on the selection of the above-mentioned components and their corresponding amount ratio, the invention also provides a preparation method of a plant type active antiflaming extinguishant, which comprises the following steps of:

step 1, preparation of plant anti-burning agent:

as shown in FIG. 1, dry clove, lemon peel, corncob, eggplant, sugar beet pulp (dry basis) are cut into 5-15 mm blocks, and the blocks are added to the active water according to the proportion of weight, soaking at room temperature for 10-12 hours, and then keeping still at 80-85 centigrade degree for 6 hours, and discharging and filtering the material when the temperature falls below 35 centigrade degree, wherein the liquid supernatant is the plant anti-burning agent;

step 2, preparation of plant slag water:

As shown in FIG. 2, the slag of plant type material extracted with the plant anti-burning agent is dried in the sun and incinerated in the incinerator to produce the plant slag ash. Adding the plant slag ash to the tap water for soaking wet, then stirring for 30 minutes, keeping still for 24 hours, and keeping on stirring for 30 minutes, after another 24 hours, the material is finally discharged and filtered, wherein the liquid supernatant is the plant slag ash agent.

step 3, preparation of plant type antiflaming extinguishant:

As shown in FIG. 3, quantitative plant slag ash water is added to a agitation reactor, and the quantitative plant anti-burning agent is then added while stirring. Raising the temperature to 50-55 centigrade degree and stirring for 2 hours at 50-55 centigrade degree. Discharging and filtering the material when the temperature falls below 38 centigrade degree, and the plant type active antiflaming extinguishant is produced in the end.

Wherein, the total amount of the pectin, the dissolved oil, the limonene, the cresol lactone, the unsaturated organic acid, polyhydroxy compounds rich in tannin and plant protein contained in the plant anti-burning agent produced in the step 1 is not less than 17%.

Wherein, the amount of plant slag ash and water in step 2 is 2-8: 92-98; preferably, the amount of plant slag ash and water in step 2 is 3-6: 94-97; more preferably, the amount of plant slag ash and water in step 2 is 5:95.

Further, the present invention also provides an application of the plant type active antiflaming extinguishant in extinguishing fires. Specifically, the plant active antiflaming extinguishant is mixed with water at a concentration of 1 to 5%, and is filled into a portable fire extinguisher, a foam gun, a fire engine, or is used with a large scale fire-fighting equipment.

The main technical indexes of the plant type active antiflaming extinguishant are as shown in Table 1:

TABLE 1

| According to GB15308-2006 standard | | | | |
|---|---|---|---|---|
| No. | Name of Test Items | Standard Requirement | Test Result | Conclusion |
| 1 | PH value | 6.0-9.5 | 7.5 | Pass |
| 2 | Foaming expansion | ≥5.0 | 6.8 | Pass |
| 3 | 25% drainage time/min | ≥3.5 | 10 | Pass |
| 4 | Extinguishing time/min | ≤3.0 | 2.5 | Pass |
| 5 | 25% anti-burning time/min | ≥10.0 | 15 | Pass |
| 6 | Surface tension(mN/m) | ≤19 | 16.5 | Pass |
| 7 | Corrosion rate{mg/(d · dm$^2$)} | Q235Steel sheet ≤15 | 1.5 | Pass |
| | | LF21 Aluminum sheet ≤15 | 1 | Pass |

Effect comparison between the plant type antiflaming extinguishant and other fire extinguishing agents, as shown in Table 2 below:

TABLE 2

| Antiflaming extinguishant | Test times | Concentration | Supply intensity of mixed fluid (L/S) | Extinguishing effect on wood (A) | Extinguishing effect on alcohol (B) | Extinguishing effect on liquefied gas (S) | Extinguishing effect on industrial solvent | Comment |
|---|---|---|---|---|---|---|---|---|
| Plant type composite flame retardant active agent + anti-burning agent | 1<br>2 | 3<br>3 | 0.1<br>0.1 | 2<br>2 | 89<br>89 | 5<br>6 | 113<br>113 | Extinguishing control time under the same condition |
| Plant composite flame retardant active agent + active water (CN1005719C) | 1<br>2 | 6<br>6 | 0.1<br>0.1 | 2<br>4 | 3<br>4 | 12<br>9 | 4<br>6 | |
| Plant composite Flame retardant active agent + regular water | 1<br>2 | 3<br>3 | 0.1<br>0.1 | 1<br>1 | 34<br>34 | 16<br>17 | 55<br>55 | |
| Aqueous film forming fire extinguishing agent | 1<br>2 | 3<br>3 | 0.1<br>0.2 | 1A out of control<br>1 | 22<br>22 (almost out of control) | | 34<br>34 | |
| Light water foam fire extinguishing agent | 1<br>2 | 3<br>3 | 0.1<br>0.2 | 1A out of control<br>1 | 34<br>34 | | 55<br>55 | |

The present invention will now be described in more detail by way of example with reference to specific embodiments thereof, and the following examples are not to be construed as limiting the scope of the invention.

Embodiment 1

In the present embodiment 1, the plant type active antiflaming extinguishant comprises 10% of the plant anti-burning agent, 15% of the plant composite flame retardant active agent and 75% of the plant slag water; wherein the plant anti-burning is composed of the following components: 0.1% of clove, 4% of corn core, 0.5% of lemon peel, 3.6% of eggplant, 2.8% of sugar beet pulp, 89% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 5:95.

Based on the selection of the above-mentioned components and their corresponding amount ratio, now preparation is made in the following method:

step 1, preparation of plant anti-burning agent:

The dry clove, lemon peel, corncob, eggplant, sugar beet pulp (dry basis) are cut into 5~15 mm blocks, and the blocks are added to the active water according to the proportion of weight, soaking at room temperature for 10-12 hours, and then keeping intact at 80-85 centigrade degree for 6 hours, and discharging and filtering the material when the temperature falls below 35 centigrade degree, wherein the liquid supernatant is the plant anti-burning agent;

step 2, preparation of plant slag water:

The slag of plant material extracted with the plant burning resisting agent is dried in the sun and incinerated in the incinerator to produce the plant slag ash. Adding the plant slag ash to the tap water for soaking wet, then stirring for 30 minutes, standing still for 24 hours, and keeping on stirring for 30 minutes, after another 24 hours, the material is finally discharged and filtered, wherein the liquid supernatant is the plant slag ash agent.

step 3, preparation of plant antiflaming extinguishant:

Quantitative plant slag ash water is added to a agitation reactor, and the quantitative plant anti-burning agent is then added while stirring. Raising the temperature to 40-45 centigrade degree and stirring for 1 hours at 40-45 centigrade degree, and then quantitative plant composite flame retardant active agent and raising the temperature to 50-55 centigrade degree and stirring for 2 hours at 50-55 centigrade degree. Discharging and filtering the material when the temperature falls below 38 centigrade degree, and the plant type active antiflaming extinguishant is then produced.

Embodiment 2

The difference between Embodiment 2 and Embodiment 1 is as follows: in the present embodiment 2, the plant active antiflaming extinguishant comprises 10% of the plant anti-burning agent, 15% of the plant composite flame retardant active agent and 75% of the plant slag water; wherein the plant anti-burning is composed of the following components: 0.1% of clove, 6% of corn core, 1% of lemon peel, 2.9% of eggplant, 3.0% of sugar beet pulp, 87% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 5:95. The preparation method is the same as Embodiment 1, producing plant type active anti flaming extinguishant 2.

Embodiment 3

The difference between Embodiment 3 and Embodiment 1 is as follows: in the present embodiment 3, the plant type active antiflaming extinguishant comprises 12% of the plant anti-burning agent, 15% of the plant composite flame retardant active agent and 73% of the plant slag water; wherein the plant anti-burning is composed of the following components: 0.18% of clove, 3.6% of corn core, 0.7% of lemon peel, 3.6% of eggplant, 2.8% of sugar beet pulp, 89.12% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 7:93. The preparation method is the same as Embodiment 1, producing plant type active antiflaming extinguishant 3.

Embodiment 4

The difference between Embodiment 4 and Embodiment 1 is as follows: in the present embodiment 4, the plant type active antiflaming extinguishant comprises 12% of the plant anti-burning agent, 15% of the plant composite flame retardant active agent and 73% of the plant slag water; wherein the plant anti-burning is composed of the following components: 0.12% of clove, 6.2% of corn core, 1.0% of lemon peel, 3.0% of eggplant, 3.0% of sugar beet pulp, 86.68% of active water; the plant composite flame retardant active agent uses the plant type active flame fire retardant extinguishing agent described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 5:95. The preparation method is the same as Embodiment 1, producing plant type active antiflaming extinguishant 4.

Embodiment 5

The difference between Embodiment 5 and Embodiment 1 is as follows: in the present embodiment 5, the plant type active antiflaming extinguishant comprises 20% of the plant anti-burning agent, 17% of the plant composite flame retardant active agent and 63% of the plant slag water; wherein the plant anti-burning is composed of the following components: 0.1% of clove, 6% of corn core, 1% of lemon peel, 2.9% of eggplant, 3.0% of sugar beet pulp, 87% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 2-8:92-98. The preparation method is the same as Embodiment 1, producing plant type active antiflaming extinguishant 5.

Embodiment 6

The difference between Embodiment 6 and Embodiment 1 is as follows: in the present embodiment 6, the plant type active antiflaming extinguishant comprises 20% of the plant anti-burning agent, 17% of the plant composite flame retardant active agent and 63% of the plant slag water; wherein the plant anti-burning is composed of the following components: 0.08% of clove, 3.4% of corn core, 1.2% of lemon peel, 2.6% of eggplant, 3.8% of sugar beet pulp, 88.92% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 5:95. The preparation method is the same as Embodiment 1, producing plant type active anti flaming extinguishant 6.

Embodiment 7

The difference between Embodiment 7 and Embodiment 1 is as follows: in the present embodiment 7, the plant type active antiflaming extinguishant comprises 17% of the plant anti-burning agent, 15% of the plant composite flame retardant active agent and 68% of the plant slag water; wherein the plant anti-burning is composed of the following components: 0.12% of clove, 6.2% of corn core, 1.0% of lemon peel, 3.0% of eggplant, 3.2% of sugar beet pulp, 86.48% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 6:94. The preparation method is the same as Embodiment 1, producing plant type active antiflaming extinguishant 7.

Embodiment 8

The difference between Embodiment 8 and Embodiment 1 is as follows: in the present embodiment 8, the plant type active antiflaming extinguishant comprises 17% of the plant anti-burning agent, 15% of the plant composite flame retardant active agent and 68% of the plant slag water; wherein the plant anti-burning is composed of the following components: 0.1% of clove, 6% of corn core, 1% of lemon peel, 2.9% of eggplant, 3.0% of sugar beet pulp, 87% of active water; the plant composite flame retardant active agent uses the plant type active antiflaming extinguishant described in Patent No. CN1341469A; the plant slag water is composed of plant slag ash and water, and slag of plant material extracted with the plant anti-burning agent is dried in the sun and incinerated to produce the plant slag ash. The ratio of plant slag ash and water is 6:94. The preparation method is the same as Embodiment 1, producing plant type active antiflaming extinguishant 8.

The plant type active antiflaming extinguishants 1-8 prepared in the above-mentioned Embodiments 1 to 8 were randomly selected and diluted at different ratios to be filled into the fire extinguishing equipment for fire extinguishing in the following different types of fires.

Application 1

The plant type active antiflaming extinguishant prepared by the present invention is diluted at a 3% ratio and then poured into a simplified fire extinguisher (490 ml) to extinguish fires with the fire rating of 0.5a, 13b, and 5f.

By contrast, the plant type active antiflaming extinguishant using the plant slag ash and the plant type antiflaming extinguishant only without plant anti-burning agent cannot extinguish fires when under the same conditions.

Application 2

The plant type active antiflaming extinguishant prepared by the invention is mixed with water at a concentration of 3%, and 3 L of the mixed fluid is filled into a portable fire extinguisher. Extinguishing Class A fire (wood fire) according to GB4351-1997 standard and its extinguishing energy is equal to 2A, without re-ignition in 10 minutes.

By contrast, the extinguishing energy of the plant type active anti flaming extinguishant using the plant slag ash agent and the plant type flame retardant extinguishing agent only without plant anti-burning agent is only about 1A when it is done under the same conditions.

Application 3

The plant type active antiflaming extinguishant prepared by the invention is mixed with water at a concentration of 3%, and 3 L of the mixed fluid is filled into a portable fire extinguisher. Extinguishing Class B fire (industrial solvent fire) according to GB4351-1997 standard and its extinguishing energy is equal to 113B, and when ignited, open fire will not burn at 10 minutes after the fire is put out.

By contrast, the extinguishing energy of the plant type active antiflaming extinguishant using the plant slag ash agent and the plant type flame retardant extinguishing agent only without plant anti-burning agent is only about 55B when it is done under the same conditions.

Application 4

The plant type active antiflaming extinguishant prepared by the invention is mixed with water at a concentration of 3%, and 3 L of the mixed fluid is put into a portable fire extinguisher. Extinguishing Class B fire (acetone fire) according to GB4351-1997 standard and its extinguishing energy is equal to 89B, and when ignited, open fire will not burn at 10 minutes after the fire is put out. By contrast, the extinguishing energy of the plant type active antiflaming extinguishant without using the plant anti-burning agent is only about 34B when it is done under the same conditions.

Application 5

The plant type active antiflaming extinguishant prepared by the invention is mixed with water at a concentration of 3%, and 3 L of the mixed fluid is put into a portable fire extinguisher for extinguishing Class C fire (25 L packed liquefied petroleum gas fire). The extinguishing time is 5 s, and the mixed liquid consumption is 1.1 L.

By contrast, as for the plant type active antiflaming extinguishant using the plant slag ash agent and the plant type antiflaming extinguishant only without plant anti-burning agent, its extinguishing time is 20 s when it is done under the same conditions.

Application 6

The plant type active flame retardant extinguishing agent prepared by the present invention was dispensed at a concentration of 3%, using a PQ8 (3% concentration) foam gun to suppress a fire (light oil fire) of 50 $m^2$. With the support of Ningbo Fire Protection Association and Ningbo Fire Brigade, the fire extinguishing time was less than or equal to 55 s at the fire protection test site of Ningbo Yinzhou District. By contrast, as for the plant type active antiflaming extinguishant without using the plant anti-burning agent, its extinguishing time was greater than 180 s when it is done under the same conditions.

Application 7

The plant type active antiflaming extinguishant prepared by the present invention was dispensed at a concentration of 3%, using a PQ8 (3% concentration) foam gun to suppress a fire (alcohol fire) of 50 $m^2$. With the support of Ningbo Fire Protection Association and Ningbo Fire Brigade, the fire extinguishing time was less than or equal to 98 s at the fire protection test site of Ningbo Yinzhou District.

By contrast, as for the plant type active antiflaming extinguishant without using the plant anti-burning agent, its extinguishing time was greater than 300 s when it is done under the same conditions.

Application 8

The plant type active antiflaming extinguishant prepared by the present invention was dispensed at a concentration of 3%, using two high spray foam gun of 32 to suppress 5000 tons of oil tank (light oil fire at the site of Ningbo Zhenhai Refining Company, the First National Rescue Techniques Competition in Hazardous Chemical Accidents, and its extinguishing time was 97 s.

By contrast, as for the plant type active antiflaming extinguishant without using the plant anti-burning agent, its extinguishing time was greater than 480 s when it is done under the same conditions.

Specifically, the plant type antiflaming extinguishant of the present invention participated in the First National Rescue Techniques Competition in Hazardous Chemical Accidents on a full scale of 5,000 cubic meters of large oil storage tank (gasoline) fire fighting contest on Oct. 22, 2015, wherein two high-spraying engines were used to extinguishing fire, with extinguishing time amounting to 1 minute and 37 seconds, having an excellent fire extinguishment result.

In addition, with the strong support of Ningbo Fire Protection Association, Ningbo Fire Brigade, the on-site verification for $50^2$ m light oil was held on Jun. 19, 2016, wherein a total of four oil pools were involved, and carried out comparative experiments on the domestic aqueous film, American F500, the previous plant active extinguishing agent respectively. The results showed that the comprehensive data of the plant type antiflaming extinguishant was 3 times higher than that of aqueous film, 2 times higher than that of American F 500, and one time higher than that of plant type antiflaming extinguishant.

Application 9

Figure 4:
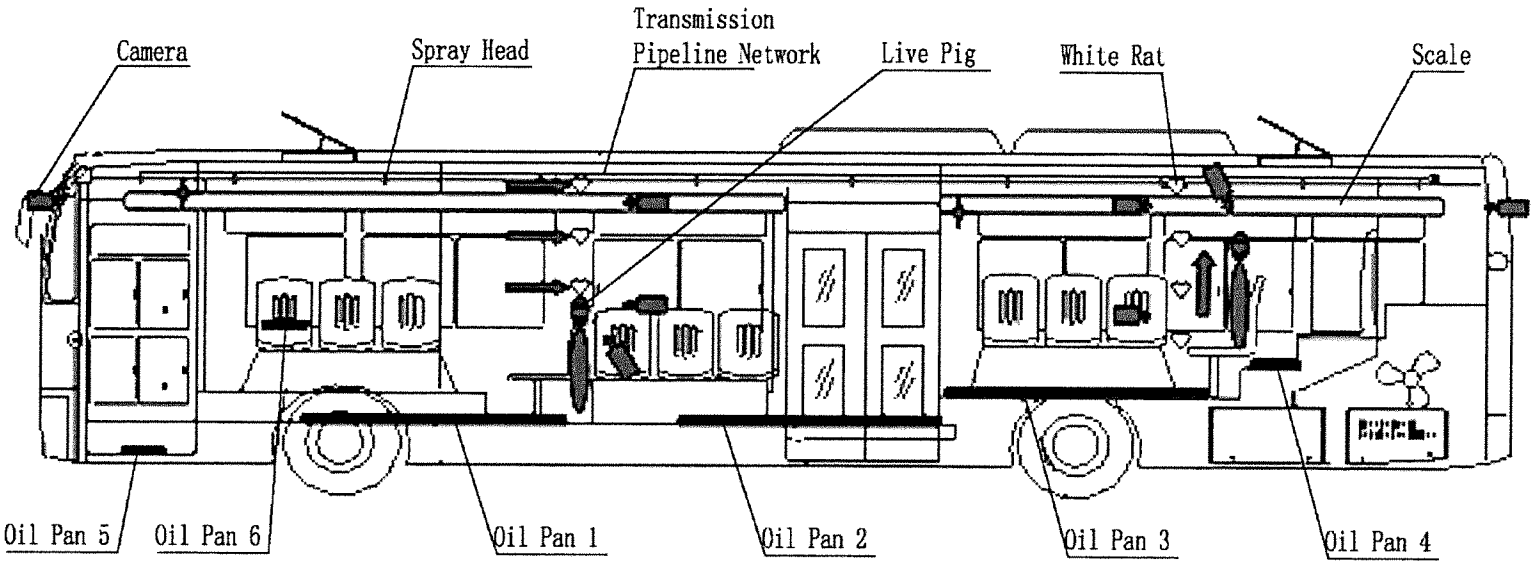
FIG. 4 is an experimental model arrangement diagram of an automatic fire extinguishing in bus system and in vivo experiment using the plant type antiflaming extinguishant according to the present invention.
Figure 5:
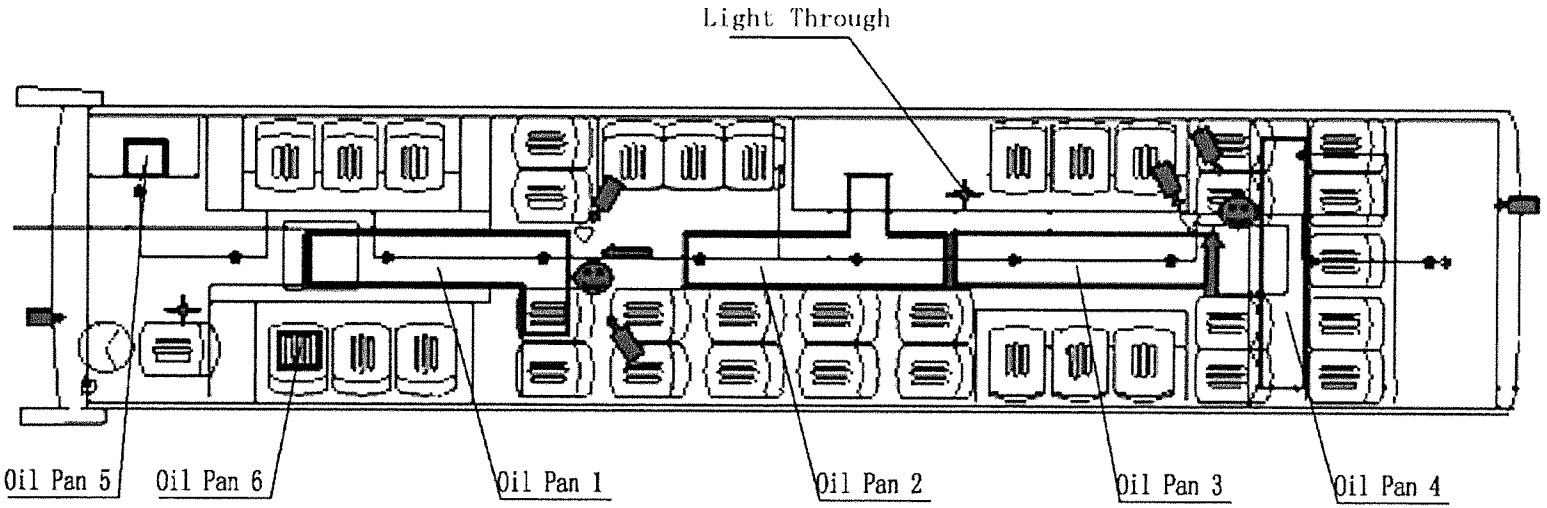
FIG. 5 is a plan view of the experimental model arrangement shown in FIG. 4.

Automatic fire extinguishing in bus system and in vivo experiment:

1. Test Method:

Arrangement of test living body: According to the experimental model arrangement diagram of an automatic fire extinguishing in bus system and in vivo experiment shown in FIG. 4-5, arranging live pig, white rat, and front, rear living body in the living position. One rate cage is for two rats only, and the rate cage is made of metal material. The model (different gestures, different fabrics, and different lengths) dresses were placed in the seat and on the aisle respectively, occupying the whole cabin.

The front live pig is positioned in the aisle, on the ground between two oil pans, and dividing the live animals into three layers, such that the mouth from the top is about 1.3 m. The rear live pig is positioned in the 3 oil pan in the rear compartment aisle, arranging them in 3 layers.

The front and rear rats in the indicated position are arranged at a distance of 0.4 m, 0.8 m, 1.2 m, 1.6 m from the floor, from low to high. Camera layout: camera consists of 2 high-definition visibility cameras and 6 common live monitoring cameras, a total of 8. Processing of waterproof and fire prevention is required before arrangement.

Arranging one high-definition visibility camera in the front and rear of the cabin, and it is 0.3-0.4 m from the car roof. From the 0.5 m of a scale, set a returning light target plate every 0.5 m, the farthest to 10 m, and the scale height from the roof is 0.4-0.5 m. The test process is recorded via a video recording.

Live monitoring camera is set for each of the front and rear live pig, and one for two rat cages, and the test process is recorded via video recording.

Temperature test point layout: the original four test points remain unchanged, with two points to test live pig respiratory temperature, with 4 points to test the temperature where the distance is 0.5 m from the ground.

3. Debugging and getting all the test equipments in place, in particular, picture of the live monitoring camera should be clear and stable.

4. Filling each of the four oil tanks with fuel oil through a hose, in the sequence of 0.7, 0.6, 0.6, 0.6, a total of 2.5 liters of 90 # gasoline.

5. Closing the two doors, and igniting.

At 5 seconds after the ignition, open the door, then after 10 seconds, start the automatic fire extinguishing system, and extinguish the fire with the plant type flame retardant extinguishing agent, and it takes 5 seconds to extinguish the cabin fire.

In the experiment, the live animals were not injured, but ten of the models had burn injuries of different degrees, among which 6 were in standing posture, and 2 were in sitting posture, with all the burn injuries in the lower part of the body. No burn injury had been found on the part protected by the fire extinguishing agent, indicating that the fire extinguishing agent had good flame resistance and good insulation performance.

6. Experimental results: Most of the rats in vivo test were not affected by harmful smoke, of which the two rats in the rat's cage in the uppermost part of the front compartment were slightly poisoned, with hypoxia response and poor spirit. After dissection, nothing abnormal was seen in one of the rats, and the other recovered. By contrast, without using the plant burning resisting agent, under the same conditions, the extinguishing time was greater than 20 seconds. Among them, the two rats in the rat's cage in the uppermost part of the front compartment died from poisoning and lack of oxygen, and the live pig was in a coma, and ten of the models had burn injuries of different degrees, among which 6 models in standing posture were severely burned, and 2 models in sitting posture were severely burned.

In summary, the plant type active flame retardant extinguishing agent of the present invention adds a variety of plant fruits. It not only has the function of changing the physical nature of a combustion material, rapid cooling, achieving flame retardancy through dilution, and film sealing, but also be more environment friendly to the emissions of post extinguishment and emission of the expired products, which in turn has good impact on the treatment of sewage and riverbed, has the function of maintaining trees and flowers, and enables to relieve the harm brought by the environmental pollution. All the functions coordinate and interact with one another, so as to obtain a strong fire extinguishing function and a more ideal fire extinguishing effect, increase the different sources of plant protein, pectin, polyhydroxy compounds rich in tannin, lignin and anti-burning material, Fire and anti-burning to a great effect, the film sealing performance is good, the resulting fire-retardant firepower is huge, which is beyond the reach of the existing fire extinguishing agent.

While specific embodiments of the present invention have been described in detail above, it is by way of example only and the invention is not limited to the specific embodiments described above. It will be apparent to those skilled in the art that any equivalent modifications and substitutions to the present invention are within the scope of the present invention. Accordingly, equivalent variations and modifications not departing from the spirit and scope of the invention are intended to be included within the scope of the invention.

What is claimed is:

1. A plant active antiflaming extinguishant, comprising a plant anti-burning agent, a plant composite antiflaming active agent and a plant slag water;

wherein, the plant anti-burning agent comprises the following components by weight percentage:

| | |
|---|---|
| clove | 0.05-0.18% |
| corncob | 2.6-10% |
| lemon peel | 0.4-1.5% |
| eggplant | 2.4-3.6% |
| sugar beet pulp | 2.2-3.8% |
| active water | 84-90%; |

wherein the active water is made from grain stillage and plant ash through water leaching, and the grain stillage having dry basis of 12-20 parts plant ash has 3-5 parts, and water is added to the total weight, amounting to 100 parts;

wherein the preparation of the plant anti-burning agent includes that;

the dry clove, lemon peel, corncob, eggplant, sugar beet pulp (dry basis) are cut into 5~15 mm blocks, and the blocks are added to the active water in sequence according to the proportion of weight, soaking at room temperature for 10-12 hours, and then preserving at 80-85 centigrade degree for 6 hours, and discharging and filtering plant material when the temperature falls below 35 centigrade degree, so as to obtain a liquid supernatant which is the plant anti-burning agent;

wherein, the plant slag water is composed of plant slag ash and water, and the plant slag ash is produced by drying slag of plant material extracted from the plant anti-burning agent in the sun and burning it;

wherein the preparation of plant slag water includes that:

the slag of plant material, which is extracted from the plant anti-burning agent and burnt in an incinerator after dried in the sun, is added into tap water for soaking, then stirring for 30 minutes, standing still for 24 hours, and keeping on stirring for 30 minutes, after standing still for another 24 hours, the plant material is discharged and filtered, wherein the liquid supernatant is the plant slag water.

2. The plant active antiflaming extinguishant according to claim 1, wherein the plant type active antiflaming extinguishant comprises the following components by weight percentage:

| | |
|---|---|
| plant anti-burning agent | 10-20% |
| plant composite antiflaming active agent | 8-17% |
| plant slag water | 63-82%. |

3. A preparation method of the plant active antiflaming extinguishant according to claim 1, the plant active antiflaming extinguishant comprising the plant anti-burning agent, the plant composite antiflaming active agent and the plant slag water, the method comprising the steps of:

step 1, preparation of the plant anti-burning agent:

the dry clove, lemon peel, corncob, eggplant, sugar beet pulp (dry basis) are cut into 5-15 mm blocks, and the blocks are added to the active water in sequence according to the proportion of weight, soaking at room temperature for 10-12 hours, and then preserving at 80-85 centigrade degree for 6 hours, and discharging and filtering plant material when the temperature falls below 35 centigrade degree, so as to obtain a liquid supernatant which is the plant anti-burning agent;

step 2, preparation of plant slag water:

the slag of plant material, which is extracted from the plant anti-burning agent and burnt in an incinerator after dried in the sun, is added into tap water for soaking, then stirring for 30 minutes, standing still for 24 hours, and stirring again for 30 minutes, after standing still for another 24 hours, the plant material is discharged and filtered, wherein the liquid supernatant is the plant slag water;

step 3, preparation of plant antiflaming extinguishant:

plant slag water is added to an agitation reactor, and the plant anti-burning agent is then added while stirring, raising the temperature to 40-45 centigrade degree and stirring for 1 hour at 40-45 centigrade degree, and then the plant composite antiflaming active agent is added, and raising the temperature to 50-55 centigrade degree and stirring for 2 hours at 50-55 centigrade degree; discharging and filtering when the temperature falls below 38 centigrade degree, and the plant active antiflaming extinguishant is the produced.

4. The preparation method of the plant active antiflaming extinguishant according to claim 3, wherein a total amount of pectin, dissolved oil, limonene, cresol lactone, unsaturated organic acid, polyhydroxy compounds rich in tannin and plant protein contained in the plant anti-burning agent prepared in step 1 is not less than 17%.

5. The preparation method of the plant active antiflaming extinguishant according to claim 3, wherein the weight ratio of the plant slag ash and the water in step 2 is (2-8):(92-98).

6. The method of using the plant active antiflaming extinguishant according to claim 1 in extinguishing fires, wherein the plant active antiflaming extinguishant is mixed with water at a concentration of 1 to 5%, and is filled into a portable fire extinguisher, a foam gun, a fire engine, or is used with a large scale fire-fighting equipment.

* * * * *